US009546492B2

(12) United States Patent
Coenraets

(10) Patent No.: US 9,546,492 B2
(45) Date of Patent: Jan. 17, 2017

(54) DEVICE FOR COVERING A SURFACE, COMPRISING A MOBILE DRUM COVERED WITH A PROTECTIVE CASING

(71) Applicant: Becoflex S.A., Wauthier-Braine (BE)

(72) Inventor: Benoit Coenraets, Wauthier-Braine (BE)

(73) Assignee: Becoflex S.A., Wauthier-Braine (BE)

( * ) Notice: Subject to any disclaimer, the term of this patent is extended or adjusted under 35 U.S.C. 154(b) by 0 days.

(21) Appl. No.: 14/439,333

(22) PCT Filed: Nov. 5, 2013

(86) PCT No.: PCT/EP2013/073008

§ 371 (c)(1),
(2) Date: Sep. 2, 2015

(87) PCT Pub. No.: WO2014/068131

PCT Pub. Date: May 8, 2014

(65) Prior Publication Data

US 2016/0047134 A1 Feb. 18, 2016

(30) Foreign Application Priority Data

Nov. 5, 2012 (BE) ..... 2012/0749

(51) Int. Cl.
*E04H 4/10* (2006.01)
*A63C 19/12* (2006.01)

(52) U.S. Cl.
CPC ..... *E04H 4/101* (2013.01); *A63C 19/12* (2013.01)

(58) Field of Classification Search
CPC .. E04H 4/084; E04H 4/101; E06B 2009/1743; A63C 19/12

(Continued)

(56) References Cited

U.S. PATENT DOCUMENTS 3,273,171 A * 9/1966 Lamb ..... E04H 4/101 16/23
4,001,900 A * 1/1977 Lamb ..... E04H 4/10 4/498

(Continued)

FOREIGN PATENT DOCUMENTS

DE 2257231 A1 5/1974
EP 1719858 A2 11/2006

(Continued)

OTHER PUBLICATIONS

International Search Report for Application No. PCT/EP2013/073008 dated Feb. 18, 2014.

*Primary Examiner* — Blair M Johnson
(74) *Attorney, Agent, or Firm* — Norris McLaughlin & Marcus, P.A.

(57) ABSTRACT

The invention relates to a device (1) for covering a surface (3) of which the contour defines a surface plane, said device comprising: (a) a substantially rectangular cover (10) wound onto (b) a drum (2) which is rotatably mounted on a carriage that can wind up or unwind the cover (10) by movement of the carriage in a longitudinal direction of the surface and thus allows the deployment of the cover or the removal thereof from the surface (3); and (c) a protective casing (20) mounted on said carriage, characterized in that the distance between the edge of the casing and the edge of the surface varies between a first stopping position $d_p$, and a second movement position $d_m$ when the carriage moves the drum over the surface (3), and in that $d_m > d_p$.

14 Claims, 2 Drawing Sheets

(58) Field of Classification Search
USPC ..... 160/243, 242, 246, 249
See application file for complete search history.

(56) References Cited

U.S. PATENT DOCUMENTS

| | | | | |
|---|---|---|---|---|
| 4,195,370 | A | 4/1980 | Budd | |
| 4,466,143 | A * | 8/1984 | Lamb | E04H 4/101 4/498 |
| 8,418,279 | B2 * | 4/2013 | Coenraets | A01G 9/227 160/273.1 |
| 2010/0004076 | A1 * | 1/2010 | Hansez-Gonne | A63C 19/12 473/504 |
| 2011/0119823 | A1 | 5/2011 | Coenraets | |
| 2011/0290433 | A1 * | 12/2011 | Coenraets | A63C 9/12 160/311 |
| 2014/0000021 | A1 * | 1/2014 | Scheps | E04H 4/101 4/498 |
| 2015/0284969 | A1 * | 10/2015 | Coenraets | B60J 7/085 150/154 |
| 2016/0047134 | A1 * | 2/2016 | Coenraets | E04H 4/101 160/243 |

FOREIGN PATENT DOCUMENTS

| | | | |
|---|---|---|---|
| FR | 900951 | A | 7/1945 |
| FR | 2743502 | A1 | 7/1997 |
| FR | 2789425 | A1 | 8/2000 |
| FR | 2803769 | A1 | 7/2001 |
| FR | 2893651 | A1 | 5/2007 |
| WO | 2005026473 | A1 | 3/2005 |
| WO | 2007036625 | A1 | 4/2007 |
| WO | 2010010152 | A1 | 1/2010 |
| WO | 2010054960 | A1 | 5/2010 |

* cited by examiner

DEVICE FOR COVERING A SURFACE, COMPRISING A MOBILE DRUM COVERED WITH A PROTECTIVE CASING

This application is a 371 application of PCT/EP2013/073008 filed Nov. 5, 2013, which claims foreign priority benefit under 35 U.S.C. §119 of Belgium Application No. BE 2012/0749 filed Nov. 5, 2012.

FIELD OF THE INVENTION

The invention relates to a device for covering a surface, easy to implement and meeting the requirements of the application concerned. In particular, the present invention relates to a cover device of the moving drum type, comprising a particularly effective protective casing.

TECHNOLOGICAL BACKGROUND

Covers are applied to surfaces for reasons which depend on the nature of these surfaces. Thus, in the case of a pond such as a swimming pool, the cover can avoid pollution by leaves or animals and provide savings on energy, water and reagents, and can or must ensure safety of people, in particular of children. In a desalination pond or other fluid treatment pond, a cover makes it possible to avoid the liquid dilution due to rain or excessive evaporation due to heat.

In the case of a sports field such as a dirt or grass outdoor tennis court, a cover makes it possible to protect it against bad weather, in particular intermittent rain. Moreover, a vehicle body is notably covered to ensure the stability of the load with respect to the drop in pressure caused by the movement of the vehicle and protect it against bad weather. Covers are also used as blinds for greenhouses, winter gardens or vehicle windows in order to avoid any internal overheating, and as solar protection for terrace awnings.

In all cases, the aim is generally to obtain an economical cover device that allows for easy, safe, reproducible and rapid covering and uncovering, requiring minimal human intervention and, above all, that has a life that is as long as possible. Many devices for covering a surface have been developed, ranging from the basic models to the most sophisticated. Among the latter, the moving drum devices can be cited.

In a moving drum cover device, the motorized drum is mounted on a longitudinal translation mechanism. The latter moves the drum over the surface to be covered which literally makes it possible to "lay" the cover on the surface, upon its deployment, by unwinding it simultaneously from the drum during its longitudinal movement, then lift it, upon its removal, by winding it simultaneously onto the drum. The cover therefore does not slip over the surface either upon its deployment or upon its removal. The cover device also comprises a system for fixing the cover at a first transverse end of the surface to be covered such that the translation and the rotation of the drum cause the unwinding or the winding of the cover on the surface to be covered. Examples of automatic devices of this type are disclosed, for example, in the following documents: WO2005/026473, FR2900951, DE2257231, FR2893651, FR2789425, FR2743502, EP1719858, and on the website www.kimbay.fr. Moreover, a completely manual variant of the drum mounted with longitudinal translation is illustrated in the documents WO2007/036625 and U.S. Pat. No. 4,195,370.

In the present application, the terms "longitudinal", "transverse", and their derivatives, refer respectively to the direction of movement of the drum and to the direction of the axis of revolution thereof.

The moving drum cover devices illustrated above provide only a fixing of a transverse edge of the cover at a transverse end of the surface to be covered, the opposite edge remaining secured to the drum. No system for fixing the longitudinal edges of the cover is provided. In particular, in the case of a swimming pool, people moving onto the cover would not be retained by its longitudinal edges and could thus be plunged into the water. Furthermore, the lack of sealing of the cover on its longitudinal edges can promote the ingress into the swimming pool of dirt, dead leaves and twigs, as well as small animals such as mice or snakes. More sophisticated devices have been proposed that make it possible to reversibly fix the longitudinal edges of the cover upon its deployment, as in the document FR2803769 which provides a system for fixing the longitudinal edges of the cover consisting of grid sections that are raised then folded back section by section on said longitudinal edges of the cover by keeping these edges inside a gutter as the latter is unwound. In this design, the longitudinal edges of the cover are gripped without being locked, which provides lesser security, particularly in the case of swimming pools.

Another advantageous system that makes it possible simultaneously to fix the longitudinal edges of the cover upon its deployment and exert a transverse pulling force thereon to tighten it perfectly has been disclosed in WO2010/010152 and in WO2010/054960. In these devices, the longitudinal edges of the cover are provided with a cord or sealing bead which is introduced into the upwardly oriented opening of a rail in the form of a "U" section profile member, with one or two fins partially closing said opening. The sealing bead which slips under a fin and is retained in this position by suitable fixing means makes it possible to securely fix the longitudinal edges of the cover.

Even in the moving drum devices comprising means for fixing the longitudinal edges, at most three of the four edges of the cover can offer a relatively tight contact with the surface forming the perimeter of the surface to be covered: the two longitudinal edges, and the first transverse edge of the cover which is fixed to a first end of a surface to be covered. The second transverse end, the one where the drum is parked, cannot be sealed because it is simply laid on the surface of said lateral edge, falling from the drum. A current of air or of wind slipping under the drum can open a space between the second lateral end of the surface and the cover, thus allowing contamination of the surface despite it being covered. For example, in the case of swimming pools, this can be reflected in a contamination by leaves, twigs, grit, and even animals, potentially being introduced into the pond, despite the presence of the cover.

Also, a protective casing can be added, mounted on a carriage supporting the drum. Said casing is open on its face facing toward the surface to be covered forming a skirt defining a cavity containing the carriage and the drum. The casing comprises a rim defining the perimeter of its open face. Such a carriage has a function that is primarily esthetic, because it conceals the longitudinal translation mechanism of the carriage and the drum. Above all it serves a protective function for said translation mechanism and the drum. In the case of a swimming pool, the casing can also serve as a bench when it is parked at one or other of the transverse ends of the pool. It is clear that such a casing makes it possible to reduce the penetration of the wind under the cover, when the latter is deployed. However, in order to allow the movement of the carriage, the rim of the casing must at all points be located over obstacles located over the entire width of the surface upon the movement in the longitudinal direction of the carriage. For this reason, it is essential to leave a minimum space, $d_m$, between the rim of the casing and a plane defining the outline of the surface, such that the space, $d_m$, is greater than the height, $h_o$, relative to said plane of any obstacle located in the path of the carriage and of its casing. Such obstacles can be a protruding sun deck, pebbles, reinforcing profiles, etc. This space, $d_m$, between the rim of the casing and the plane defining the edge of the surface does not therefore make it possible to satisfactorily seal the last side of the surface.

The risk of lifting of the cover can be minimized by fixing a batten of metal or other material with high density, extending in the transverse direction of the cover, at a position corresponding to the second end of the surface to be covered. The weight of the batten makes it more difficult for wind or an animal to open a space between the edge of the surface and the cover. This solution is not however optimal because, on the one hand, in strong winds, the weight of the batten becomes insufficient to maintain the contact of the cover with the lateral edge of the surface and, on the other hand, the batten adds thickness to the drum when the cover is wound.

There therefore remains a problem in sealing the four sides of a surface covered by a cover deployed by a moving drum system. The present invention proposes a particular protective casing, making it possible to seal the two transverse sides of the surface when a cover is deployed.

SUMMARY OF THE INVENTION

The invention is as defined in the main claim and preferred variants are defined in the dependent claims. The present invention notably comprises a device for covering a surface of which the outline defines a surface plane, said device comprising:

(a) a substantially rectangular cover having two longitudinal edges opposite one another and two transverse edges opposite one another, a first transverse edge of the cover being fixed to a first transverse end of the surface, (b) a drum rotationally mounted suitable for winding or unwinding the cover, said drum being mounted on a carriage provided with a longitudinal translation mechanism enabling it to move the drum over the surface in the longitudinal direction thereof, away from or toward the first transverse end of the surface, thus allowing the deployment, respectively removal, of the cover on, respectively from, the surface, (c) a protective casing mounted on said carriage, said casing being open on its face facing toward the surface to be covered forming a skirt defining a cavity containing the carriage and the drum, the casing comprising a rim defining the perimeter of its open face, characterized in that the casing is mounted on the carriage via height varying means, making it possible to vary the shortest distance, d, separating the surface plane from the rim of the casing between a first position, $d_p$, of parking, when the carriage is located at the end of travel at one or other of the transverse ends of the surface, and a second position, $d_m$, of movement, when the carriage moves the drum over the surface, and in that, $d_m > d_p$. It is preferable for the parking distance, $d_p$, to be less than 15 mm, even substantially zero, that is to say that there is contact between the casing and the surface plane. In case of contact, it may be advantageous in certain applications if the portion of the rim of the casing entering into contact with the surface plane in the parking position, $d_p$, is provided with a seal.

In the context of the present invention, and as commonly accepted in the art, the distance between the surface plane and a point of the rim of the casing is defined as the length of the segment normal to the plane having said point of the rim for its end. The distance, d, is therefore the value of the distance from the surface plane to the point of the rim of the casing that is closest. If the rim defines a plane substantially parallel to the surface plane, then all the points of the rim of the casing will be at the same distance, d, from the surface plane. However, the rim of the casing does not necessarily define a plane and can, on the contrary, comprise curvatures, openings, notches or protuberances. The distance, d, to the surface plane is then defined as the distance to the point of the rim closest to said surface plane.

The surface plane is defined by the surface directly surrounding the surface to be covered and on which the carriage rests and moves.

In a preferred variant of the present invention, the height varying means comprise:

(a) At least one electrical, mechanical or pneumatic cylinder, (b) A lever system, or (c) At least one worm screw.

Preferably, the height varying means comprise at least one electrical cylinder at each end of the carriage. It is advantageous if the device comprises a means for preventing the movement of the carriage as long the carriage has not reached its movement position, $d_m$. For example in the case where the longitudinal translation mechanism of the carriage comprises an electric motor that can be activated by engaging a system for activating the electric motor which, when the carriage is in parking position, $d_p$, at one or other of the transverse ends of the surface, would begin first of all by electrically activating the height varying means, preferably cylinders, in order to bring the casing to its movement position, $d_m$; before activating the motor of the carriage.

A preferred cover device of the invention is of the type in which:

(a) the longitudinal edges of the cover are each provided with a sealing bead extending along said edges, (b) the longitudinal translation mechanism comprises rails (6) placed on either side of said surface supporting the carriage, the rails each consisting of a profile member having an opening on one of its faces and oriented opposite the surface to be covered, said face comprising at least one wing situated on the side adjacent to the surface to be covered and partially closing said opening;

(c) it comprises a continuous system for locking the sealing bead of the longitudinal edges of the cover in the opening of said rails enabling the sealing bead to be engaged under the wing (*6a*) as the cover is unwound and to be disengaged as it is rewound.

In a preferred embodiment, the sealing bead is formed by a core of substantially prismatic geometry, preferably substantially cylindrical, contained in a tubular sheath provided over its entire length with a strip fixed to at least one face of the cover and in which the core is preferably fixed to the tubular sheath so as to prevent it from sliding along the sheath, while maintaining a flexibility of the sealing bond that is sufficient for the operations of unwinding/winding of the cover over the surface to be covered.

A particularly preferred device of the invention is such that the carriage transversely overhanging the surface to be covered and supporting the drum comprises, at each of its ends:

(a) a driving wheel of which the axis of rotation is parallel to that of said drum;

(b) at least two castors resting on the rails and allowing the longitudinal translation of the carriage, and being mounted on either side of the driving wheel, and forming with the latter a triangle of which the driving wheel forms the top vertex; and the translation mechanism comprises two flexible belts fixed only at each of their ends to the four corners of the surface to be covered, each of the two belts:

(c) being arranged in the opening of the rails in the lateral sections contained between a fixing point and the castor closest to said fixing point, and (d) capping, without slip, the driving wheel in the central section contained between the two castors.

Such a device operates as follows:

(a) upon the unwinding of the cover (=deployment of the cover), the sealing bead of each longitudinal edge of the cover is inserted into the opening of the corresponding rail as the carriage advances and is blocked therein by the insertion, immediately after, into the same opening of the lateral section (31*a*) of belt directly adjacent to the castor downstream of the direction of translation of the carriage, and (b) upon the rewinding of the cover (=removal of the cover), the central section of belt (directly adjacent to the castor upstream of the direction of translation of the carriage) is removed from said opening of the rail, thus allowing the sealing bead to be disengaged from the rail and making it possible to rewind the cover onto the drum of the carriage.

The cover device preferably comprises means for modifying the relative speed of rotation between the cover winding/unwinding drum and the axis of rotation of the driving wheels. In particular, such means can include a spiral-wound spring placed inside the drum and making it possible to neutralize the difference between the speed of rotation of the driving wheels, which must remain substantially constant, and the speed of rotation of the drum, which varies with the outer diameter of the drum as the cover is wound/unwound. If the spiral-wound spring is stretched upon the unwinding of the cover, this has the advantage that, upon the rewinding of the cover, there is no need to motorize the rotation of the drum to gather up the cover.

The longitudinal translation mechanism preferably comprises a carriage mounted on the rails. The means for engaging the continuous locking system preferably comprise means for applying to the cover a pulling stress in the transverse direction upon its unwinding, said stress being maintained upon the locking of the cover in the at least one of said rails. In particular, the means for applying a transverse stress can comprise a substantially cylindrical return bearing rotationally mounted on an axis parallel to the transverse direction of the cover. This return bearing has a distal end, away from the surface to be covered, and a proximal end adjacent to said surface. The cover partially envelopes said return bearing in order to change orientation, such that the sealing bead extends beyond the distal end of the bearing and thus maintains the transverse tension upon the engagement of the sealing bead in the rail. The means for applying a transverse stress can also comprise two tensor bearings positioned between the drum and the return bearing, the two tensor bearings being separated by a distance greater than the thickness of the cover and less than the thickness of the sealing bead, in order to apply a transverse tension to the cover and guide the sealing bead beyond the distal end of the return bearing.

The device of the present invention is particularly suitable for covering surfaces such as:

(a) a pond, filled or not with a liquid, such as a swimming pool, a water retaining, treatment or desalination pond;

(b) a sports field, such as a tennis court or a cricket field;

(c) a vehicle body, (d) a glazed surface such as a greenhouse, a winter garden or a vehicle window.

BRIEF DESCRIPTION OF THE FIGURES

These aspects and other aspects of the invention will be clarified in the detailed description of particular embodiments of the invention, reference being made to the drawings of the figures, in which.

DETAILED DESCRIPTION OF PARTICULAR EMBODIMENTS

Figure 1:
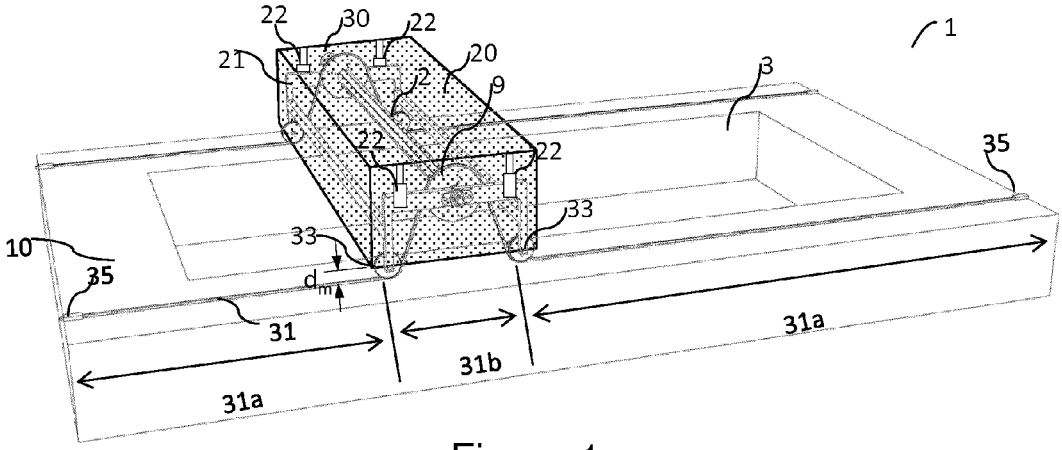
FIG. 1 is a perspective overview of a surface with the drum protected by a casing in position such that a part of the surface only is covered by a cover.

As represented in FIG. 1, the automatic device for covering (1) a surface (3) according to the invention comprises a cover (10) intended to protect said surface (3). The device (1) makes it possible to cover notably surfaces defined by the outline of a water pond such as a swimming pool, water treatment pond, waste water purification station, retention pond, desalination station, etc. However, the invention will be able to be implemented in any field requiring a surface to be covered, such as, for example, a dirt or grass tennis court, a vehicle body, a glazed greenhouse surface, window of a vehicle such as a train or bus, or of a winter garden, etc. Generally, in the present application, "surface" should therefore be understood to mean any area delimited by a perimeter.

Figure 2:
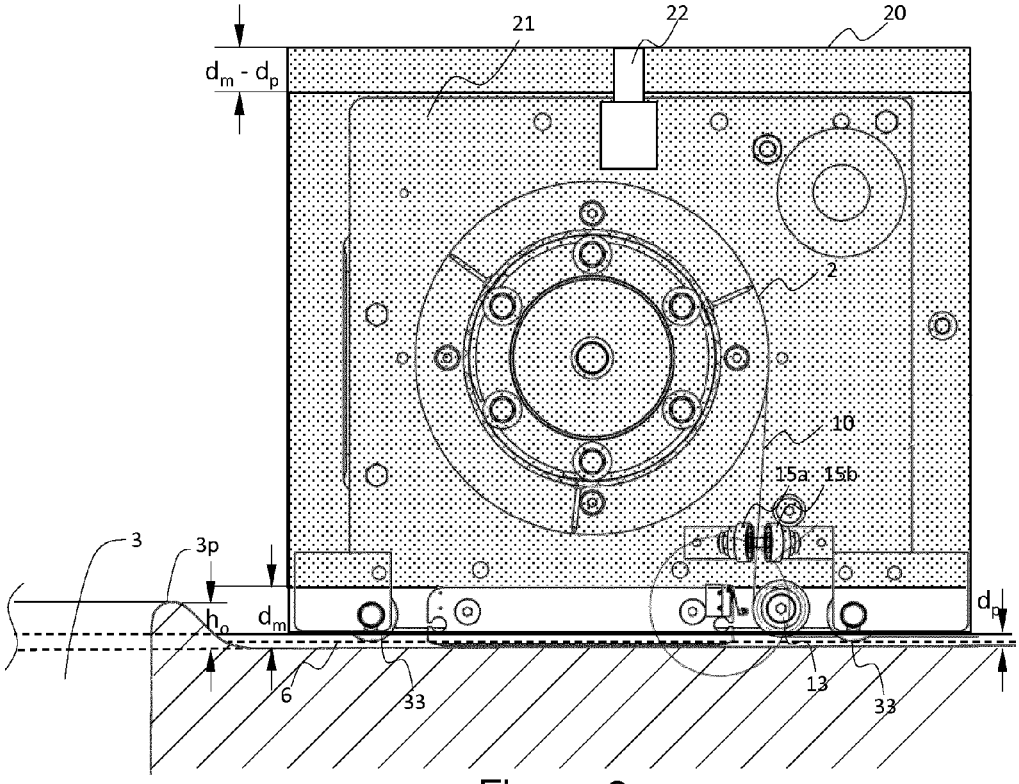
FIG. 2 is a side view of the carriage supporting the drum and on which is mounted a protective casing via cylinders.
Figure 3:
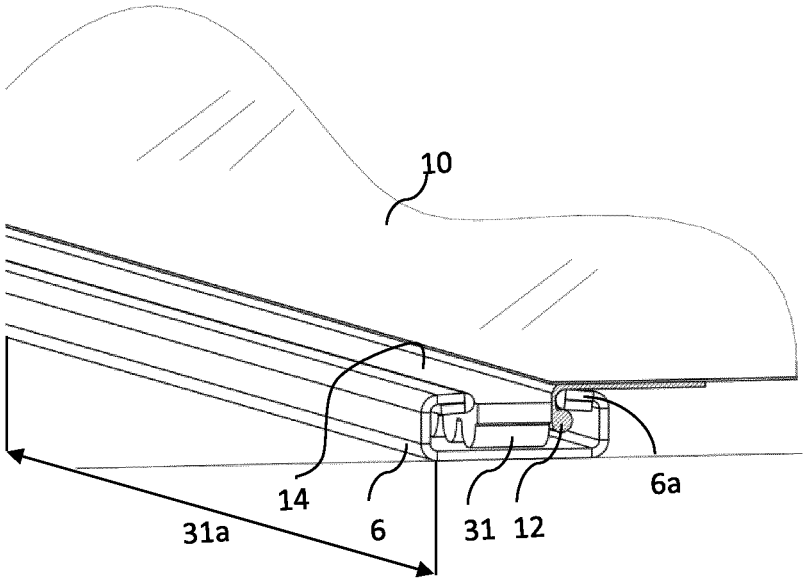
FIG. 3 illustrates a mechanism for fixing a sealing bead in the opening of a rail via a flexible belt.

The device (1) comprises a drum (2) which has a length at least equal to the width of the cover (10), the latter having to be of sufficient width and length to cover all the surface to be protected (3) when it is deployed. The drum (2) is mounted on a longitudinal translation mechanism comprising a carriage supporting the drum. As illustrated in FIGS. 1 to 3, it is advantageous for the longitudinal translation mechanism to also comprise rails (6) placed on either side of said surface (3) in order to guide the carriage on its trajectory. The drum (2) has two directions of rotation: the first direction of rotation enabling it to unwind the cover (10) to deploy it and cover the surface to be protected (3), and the second direction of rotation allowing it to wind the cover (10) in order to remove it and give access to said surface (3).

For esthetic reasons and to protect the drum and the mechanical and electrical parts of the longitudinal translation mechanism, a protective casing (20) is mounted on said carriage. The casing is in the form of a box that is open on one face, containing the carriage and the drum. In particular, the open face of the casing is the one facing toward the surface (3) to be covered. The casing thus forms a skirt defining a cavity containing the carriage and the drum, the casing comprising a rim defining the perimeter of its open face. In order to ensure an unencumbered longitudinal translation of the carriage and casing, it is essential for a certain space, $d_m$, to exist between the rim of the casing and the surface swept by the casing upon its longitudinal translation. The space, $d_m$, must be at least greater than the greatest height, $h_o$, of the obstacles located on the trajectory of the casing. Such obstacles can be of different kinds. For example, in the case of a swimming pool, it may be a raised edge of the sun deck, as schematically represented in FIG. 2, or a filter cover or drainage channel. The drawback of such a space, $d_m$, is that in its deployed position, the cover is not pressed against the transverse end of the surface to be covered located on the side of the drum. This can be particularly inconvenient for applications such as vehicle bodies or swimming pools, because the wind can blow under the cover passing through the space, $d_m$, between the casing and the surface to be covered thus moving the cover away and allowing undesirable foreign bodies to be introduced under the cover.

The present invention solves this problem by mounting the protective casing (20) on the carriage via height varying means (22), making it possible to vary the shortest distance, d, separating the surface plane from the rim of the casing between a first position, $d_p$, of parking, when the carriage is located at the end of travel at one or other of the transverse ends of the surface, and a second position, $d_m$, of movement, when the carriage moves the drum over the surface (3). It is understood that, $d_m>d_p$. In the present context, the surface plane is defined by the surface directly surrounding the surface to be covered and on which the carriage rests and moves. It is parallel to the plane that the deployed cover would define in the absence of sag deflection. If the carriage is moved on rails (6) placed on either side of the longitudinal sides of the surface to be covered, the surface plane is defined as the plane supporting the two rails. The height, $h_o$, of any obstacle protruding from the surface plane located on the trajectory of the casing is therefore measured relative to this same surface plane. If the rim around the perimeter of the casing defines a plane (that is to say that the rim is rectilinear over its entire perimeter) it is preferable for this plane to be parallel to the surface plane. This variant becomes particularly advantageous if the parking position, $d_p$, is less than 15 mm, even substantially equal to zero, which corresponds to a contact of all the perimeter of the rim of the casing with the surface plane, thus ensuring a closure of the transverse side of the covered surface where the drum is located. It is advantageous also when the surface is uncovered and the drum is located on the other transverse side of said surface because, in the case of a swimming pool, such a casing can advantageously serve as a bench, the stability of which will be increased if the rim thereof rests on the surface plane, rather than being separated therefrom by a distance, $d_m$, as is the case in the prior art. Alternatively, a portion only of the rim of the casing makes contact with the surface plane in its parking position, $d_p$. For example, if only the transverse side of the rim of the casing adjacent to the covered surface when the cover is deployed is parallel to the surface plane, the seal between the transverse edge of the cover and the corresponding transverse side of the covered surface is assured, while maintaining a circulation of air in the casing through the other edges which are not in contact. This variant is advantageous because the transverse rim of the casing bears on the cover which can thus be kept well stretched. It is also possible to obtain a seal by ensuring, for example, that all the sides of the rim of the casing, except the transverse side adjacent to the covered surface when the cover is deployed, are parallel to the surface plane. In all cases, whether there be one or more sides or all the perimeter of the rim of the casing which makes contact with the surface plane in the parking position, $d_p$, a tighter contact can be obtained if the portion of the rim which makes contact with the surface plane is provided with a seal.

If the device comprises rails (6) protruding from the surface plane, the rim of the casing will advantageously rest on the surface of the rails and will thus be separated from the plane surface by the thickness of the rails, which is generally less than 15 mm. In an alternative variant, the rim of the casing can comprise slots of suitable form and position to surround the rails protruding from the surface plane when the casing is in the parking position, $d_p$. While a perfect seal is advantageous in the case for example of vehicle body covers, a certain ventilation can be desirable in applications such as swimming pools, where the excess humidity built up in the cavity of the casing can be damaging to the mechanics and electrical system of the device. A ventilation can be obtained, for example, by having the casing rest on the protruding rails, as discussed above. In the absence of rails or if the rails are placed in channels and their visible surface is at the same level as the sun deck, the rim of the casing may not be rectilinear and include barriers and notches forming, with the surface of the sun deck, openings allowing the circulation of air in the casing. Otherwise, airing holes can be provided anywhere on the surfaces, preferably lateral surfaces, of the casing.

The means (22) for varying the height of the casing advantageously comprise at least one electrical, mechanical or pneumatic cylinder. If the longitudinal translation of the carriage (21) is ensured by an electric motor (advantageously powered by a solar panel), then the available electrical power supply can be exploited to activate the cylinder. Alternatively, a pneumatic cylinder, for example powered by a manual pump, or a mechanical cylinder, can operate without an electrical power supply. Other means (22) for varying the height of the casing can comprise a lever system, making it possible to switch from one position to the other, for example by rotation of a cam, or can comprise a worm screw. For reasons of ease of use, it is preferable to use at least one cylinder, in particular an electrical cylinder, fixed at each end, of the carriage (21).

Since the parking position, $d_p$, of the casing, which is lower than the movement position, $d_m$, is generally lower than the maximum height, $h_o$, of an obstacle located on the trajectory of the casing, $d_p<h_o<d_m$, it is essential to prevent the carriage (21) from moving and leaving one of its parking positions at one or other of the transverse ends of the surface while the casing is still in the parking position, $d_p$. For this reason, it is advantageous to provide the device of the present invention with a means preventing the movement of the carriage until the casing has reached its movement position, $d_m$. For example, if the longitudinal translation of the carriage is ensured by an electric motor provided with an activation system for starting it up, it is sufficient to prevent the starting up of the electric motor until the casing is in the movement position, $d_m$. This can be done using a switch that is engaged only once the casing is in its movement position, $d_m$, or using a detector, indicating the position of the casing to the motor activation system. For example, the motor activation system can be programmed, in the case where the casing is in the parking position, $d_p$, to first of all electrically activate the cylinders (22) to raise the casing to its movement position, $d_m$, before activating the electric motor for the longitudinal translation of the carriage (21).

The device (1) further comprises a system for fixing a first transverse edge of the cover situated at a transverse end of the surface to be covered and making it possible to drive, by tension on the duly fixed cover, the rotation of the drum (2) to unwind the cover (10) over the surface to be covered (3) when the carriage (21) moves away from said first transverse edge. Any known type of fixing system suited to the stress and safety criteria according to the application can be used for this purpose. For example, the fixing system can comprise a plurality of straps secured to the visible transverse end of the cover (10), said straps being, for example, provided with anchoring hooks which are fastened onto the transverse part of the outline delimiting the surface to be covered (3). Alternatively, the end of the cover to be fixed can be provided with eyelets which come to be fixed to the transverse edge of the surface via a series of studs, screws, a cable or any other means. These anchoring means keep the visible transverse end of the cover (10) immobilized which makes it possible to generate on said cover a longitudinal pulling force and unwind it without having to motorize the rotation of the drum (2) when it is moved to cover the surface (3).

The cover can be made of any material suited to the application concerned: synthetic or natural fabric materials, polymeric films, battens of polymer, metal or wood, etc. It can be transparent, opaque or translucent and can form a barrier to fluids or, on the contrary, be porous, and even include mesh as in a net. For example, for swimming pool or water treatment pond or similar applications, it is advantageous if the cover comprises drainage holes thus making it possible for rainwater not to build up on the cover and thus avoiding the formation of water pockets on the surface of the cover.

A longitudinal tension can be applied to the cover upon its deployment simply by ensuring that the speed of unwinding of the cover by the rotation of the drum is less than the speed of longitudinal translation of the drum, or via a brake or a spring in the drum rotation system, or by a differentiated motorized control of the rotational and translational movements of the drum. If these two speeds are synchronous, the cover will be deployed without tensions other than those generated by its own weight in the case of the cover of a surface comprising a cavity such as a swimming pool.

Figure 4:
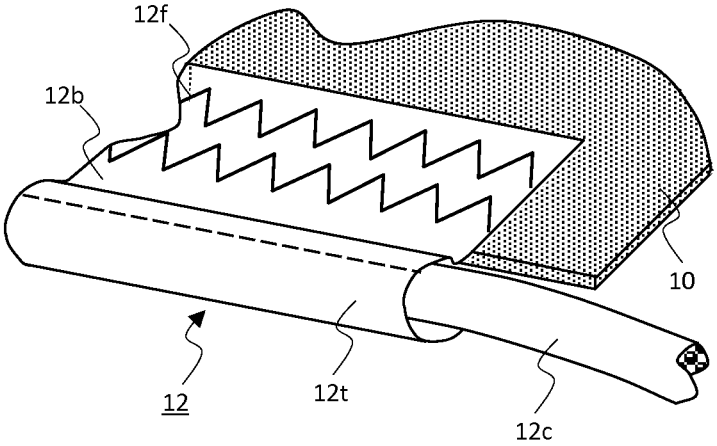
FIG. 4 shows an exemplary sealing bead suited to the present invention.

The device (1) that is the subject of the invention can advantageously comprise a continuous locking system for locking the longitudinal edges of the cover (10) in rails (6) which extend on each longitudinal side of the surface to be covered and on which the carriage (21) moves. The longitudinal edges of the cover can thus be engaged as it unwinds and be disengaged when it is wound. Such locking systems are described, for example, in WO2010010152 and WO2010054960, the content of which is included in the present application for reference. A preferred locking system to which the present invention applies comprises:

(a) two rails (6) extending along the longitudinal sides and on either side of the surface to be covered. The rails consist of a profile member having an opening (14) toward the outside (i.e. oriented away from the surface to be covered) on one of its faces and comprising one or two partially closing wings on either side of said opening (14) (if there is only one wing (6*a*) it is situated on the side adjacent to the surface to be covered);

(b) the longitudinal edges of the cover (10) each comprise at least one sealing bead (12). For example, as illustrated in FIG. 4, the sealing bead can be formed by a core (12*c*) of substantially prismatic geometry, preferably substantially cylindrical, contained in and preferably fixed to a tubular sheath (12*t*) provided over its entire length with a strip (12*b*) fixed to at least one face of the cover; other types of sealing beads, for example molded, can of course be used;

(c) engaging means (13, 15*a*, 15*b*) making it possible to engage said sealing bead (12) in the opening (14) formed by the wing(s) (6*a*) of the rail (6) and to slip it under one of the wings and fixing means (31) to prevent the sealing bead from being able to leave said opening (14), such that the cover (10) is locked to the rail (6) (see for example, FIG. 3).

Such a locking system makes it possible to slip the sealing bead (12) into the opening (14) of the rail (6) and to clamp it therein, thus resulting in the continuous fixing in said rail (6) of the corresponding longitudinal edge of the cover (10) and thereby keeping the cover (10) over the surface to be covered (3) even in the case of very strong mechanical stresses due for example to a depression or gravity. In the case of swimming pools, it provides a safety factor in the case of access (authorized or not) onto the cover. The strength of the locking system can easily reach a range of 5 to 10 kN/m (500 to 1000 kg/m) which is sufficient for many applications. Depending on the materials used, higher locking strengths can be achieved.

In a preferred embodiment, the locking system (11) of the cover device (1) comprises means for applying a transverse tension to the cover, which also guide the sealing bead toward the opening of the corresponding rail. As represented in FIG. 2, such means preferably comprise two tensor bearings (15*a*, 15*b*) separated from one another by a distance greater than the thickness of the cover and less than the thickness of the sealing bead (12), in order to apply a transverse tension to the cover. The means also preferably comprise at least one substantially cylindrical return bearing (13) mounted to rotate about an axis parallel to the transverse direction of the cover, said return bearing having a distal end, away from the surface to be covered, and a proximal end, adjacent to said surface, the cover partially enveloping said bearing (13) in order to change orientation, such that the sealing bead (12) extends beyond the distal end of the bearing. If the system comprises two tensor bearings (15*a*, 15*b*), the latter are placed between the return bearing (13) and the drum, in order to position the sealing bead of the cover when it reaches the return bearing (13) beyond the edge of its distal end.

In a particularly preferred variant of the present invention, the translation and locking system are as described in WO2010054960 and represented in FIG. 1, and comprises a carriage (21) mounted on the rails (6) and transversely overhanging the surface (3) to be covered and supporting the drum (2). The carriage supports the drum containing the cover and is topped by a protective casing as described above. Said carriage comprises, at each of its ends:

(a) a driving wheel (9) of which the axis of rotation is parallel to that of said drum (2); the two driving wheels (9) are preferably motorized;

(b) at least two castors (33) resting on the rails (6) and allowing the longitudinal translation of the carriage (21), and being mounted on either side of the driving wheel (9), and forming therewith a triangle of which the driving wheel (9) forms the top vertex; and the translation and fixing mechanism comprises two flexible belts (31) fixed only at each of their ends (35) to the four corners of the surface to be covered, each of the two belts (31):

(c) being arranged in the opening (14) of the rails (6) in the lateral sections (31*a*) contained between a fixing point (35) and the castor (33) closest to said fixing point, and (d) capping, without slip, the driving wheel (9) in the central section (31*b*) contained between the two castors (33).

Such a system is very advantageous because it fulfills multiple functions. It first of all makes it possible to move the carriage along the rails. Since the angular segment of the driving wheel (9) capped by a flexible belt (31) as described above is much greater than that covered by a straight rack, for example placed on the bottom of the rail, the risks of a driving wheel slipping are considerably reduced. Such slipping of a driving wheel would cause the carriage to skew and jam the system. A second advantage of such a system is that, between the carriage and the corners (35) of the surface to be covered, the opening (14) is blocked by the belt (31) which is inserted into the rail in its portions (31*a*). This makes it possible to reduce the ingress of foreign bodies into the rails, such as dust, gravel, twigs, etc., and also prevent a person from jamming a toe therein, for example in the case of a swimming pool. Finally, and this relates more particularly to the present invention, the belts make it possible to fix the sealing bead (12) under the wing (6*a*) of a rail as the sealing bead is introduced under the wing (6A) of the rail.

FIG. 3 illustrates a system for fixing the sealing bead under the wing (6*a*) of a rail. As discussed above, the sealing bead (12) is guided into the opening (14) of the corresponding rail by tensor (15*a*, 15*b*) and return (13) bearings. Once in the opening (14), the sealing bead would exit therefrom upon the first stress if it were not fixed. The introduction of the belt (31) into the opening of the rail directly after the introduction of the sealing bead (12) makes it possible to fix the latter under the wing (6*a*), thus preventing it from exiting therefrom. When the cover is removed from the surface, the belt is removed first, which frees the sealing bead which can exit. To sum up, the fixing system operates as follows:

(a) upon the unwinding of the cover (=deployment of the cover), the sealing bead (12) of each longitudinal edge of the cover is inserted into the opening (14) of the corresponding rail (6) as the carriage advances and is blocked therein by the insertion, immediately after, into the same opening of the lateral section (31*a*) of belt directly adjacent to the castor (33) downstream of the direction of translation of the carriage, and (b) upon the rewinding of the cover (=removal of the cover), the central section (31*b*) of belt directly adjacent to the castor (33) upstream of the direction of translation of the carriage is removed from said opening (14) of the rail, thus allowing the sealing bead (12) to be disengaged from the rail and making it possible to rewind the cover onto the drum (2) of the carriage.

The movement of the drum along a surface to be covered or uncovered generally takes place at a constant speed. The driving wheels (9) must therefore rotate at a substantially constant rotation speed. However, above all for surfaces of significant longitudinal dimensions, the outer diameter of the drum can vary considerably depending on whether the cover is deployed or removed. Since the speed of deployment/removal of the cover depends on the speed of rotation of the driving wheels (which remains generally constant) and since the outer diameter of the drum varies with the cover portion which is wound thereon, it follows therefrom that the drum and the driving wheels (9) cannot rotate at the same speed upon translation of the carriage. For covers of small dimensions, it is possible to neutralize the speed differences by a pulling force on the cover. For covers of greater longitudinal dimensions, such as for a swimming pool or a trailer of a semi-trailer, it is necessary to provide means for modifying the relative speed of rotation between the cover winding/unwinding drum and the axis of rotation of the driving wheels (9). These means can include a spiral-wound spring placed inside the drum making it possible to neutralize the difference between the speed of rotation of the driving wheels, which must remain substantially constant, and the speed of rotation of the drum, which varies with the outer diameter of the drum as the cover is wound/unwound. Upon the deployment of the cover, the drum rotates spontaneously due to the tension created by the cover which is fixed to a lateral edge of the surface to be covered. If the spiral-wound spring is stretched during the deployment of the cover (10) on the surface, there is no need to motorize the rotation of the drum either upon the gathering up and rewinding of the cover around the drum, the rotation of which is driven by the releasing of the spiral-wound spring. This system is highly advantageous because it does not require a second motor or a gear or electronic control system to rotate the drum at the appropriate speed.

A cover system according to the present invention is particularly suitable for covering surfaces such as:

(a) a pond, filled or not with a liquid, such as swimming pool, a water retaining, treatment or desalination pond;

(b) a sports field, such as a tennis court or a cricket field;

(c) a vehicle body, such as a trailer, (d) a glazed surface such as a greenhouse, a winter garden or a vehicle window.

The protective casing (22) with variable positions depending on whether the carriage (21) is moving, $d_m$, or is parked, $d_p$, at an end of the surface to be covered makes it possible to add to the protective carriage an additional function of fixing the transverse edge of the cover located on the side of the drum (2), when the latter is deployed. Such a fixing is highly advantageous, even essential, in swimming pool or semi-trailer tarpaulin applications, where the cover may be exposed to strong air currents which can easily raise its transverse edge located on the side of the drum and thus create an undesirable opening.

The invention claimed is:

1. A device for covering a surface of which the outline defines a surface plane, said device comprising:

(a) a substantially rectangular cover having two longitudinal edges opposite one another and two transverse edges opposite one another, a first transverse edge of the cover being fixed to a first transverse end of the surface (b) a drum rotationally mounted suitable for winding or unwinding the cover, said drum being mounted on a carriage provided with a longitudinal translation mechanism enabling it to move the drum over the surface in the longitudinal direction thereof, away from or toward the first transverse end of the surface, thus allowing the deployment over and removal from the surface, respectively; and (c) a protective casing mounted on said carriage, said casing being open on its face facing toward the surface to be covered forming a skirt defining a cavity containing the carriage and the drum, the casing comprising a rim defining the perimeter of its open face, wherein the casing is mounted on the carriage via height varying means, making it possible to vary the shortest distance, d, separating the surface plane from the rim of the casing between a first position, $d_p$, of parking, when the carriage is located at the end of travel at one or other of the transverse ends of the surface, and a second position, $d_m$, of movement, when the carriage moves the drum over the surface, and in that $d_m > d_p$.

2. The device according to claim 1, in which the parking distance, $d_p$, is less than 15 mm.

3. The cover device according to claim 1, in which:

(i) the longitudinal edges of the cover are each provided with a bead extending along said edges, (ii) the longitudinal translation mechanism comprises rails placed on either side of said surface supporting the carriage, each rail consisting of a profile member having an opening on one of its faces and oriented opposite the surface to be covered, said face comprising at least one wing situated on the side adjacent to the surface to be covered and partially closing said opening; and (iii) a continuous system is provided for locking the bead of the longitudinal edges of the cover in the opening of said rails enabling the bead to be engaged under the wing as the cover is unwound and to be disengaged as it is rewound.

4. The cover device according to claim 3, in which the bead is formed by a core of substantially prismatic geometry contained in a tubular sheath provided over its entire length with a strip fixed to at least one face of the cover.

5. The cover device according to claim 3, wherein the carriage hangs transversely over the surface to be covered supporting the drum, and comprises, at each of its ends:

(iv) a driving wheel of which the axis of rotation is parallel to that of said drum;

(v) at least two casters resting on the rails and allowing the longitudinal translation of the carriage, and being mounted on either side of the driving wheel, and forming with the latter a triangle of which the driving wheel forms the top vertex; and the translation mechanism comprises two flexible belts fixed only at each of a first end and a second end to the four corners of the surface to be covered, wherein each of the two belts:

(vi) is arranged in the opening of the rails in lateral sections contained between a fixing point and the caster closest to said fixing point, and (vii) caps, without slip, the driving wheel in a central section contained between the two casters.

6. The cover device according to claim 3, in which:

(i) upon the unwinding of the cover, the bead of each longitudinal edge of the cover is inserted into the opening of the corresponding rail as the carriage advances and is blocked therein by the insertion, immediately after, into the same opening of the lateral section of belt directly adj acent to the caster downstream of the direction of translation of the carriage, and (ii) upon the rewinding of the cover, the central section of the belt directly adjacent to the caster upstream of the direction of translation of the carriage is removed from said opening of the rail, thus allowing the bead to be disengaged from the rail and making it possible to rewind the cover onto the drum of the carriage.

7. The device according to claim 5, comprising means for modifying the relative speed of rotation between the cover winding/unwinding drum and the axis of rotation of the driving wheels, said means including a spiral-wound spring placed inside the drum and making it possible to neutralize the difference between the speed of rotation of the driving wheels, which must remain substantially constant, and the speed of rotation of the drum, which varies with the outer diameter of the drum as the cover is being wound/unwound.

8. The cover device according to claim 5, comprising means for applying a transverse stress comprising a substantially cylindrical return bearing rotationally mounted on an axis parallel to the transverse direction of the cover, said return bearing having a distal end, away from the surface to be covered, and a proximal end, adjacent to said surface, the cover partially enveloping said bearing in order to change orientation, such that the bead extends beyond the distal end of the bearing.

9. The cover device according to claim 8, in which the means for applying a transverse stress additionally comprise two tensor bearings positioned between the drum and the return bearing, the two tensor bearings being separated by a distance greater than the thickness of the cover and less than the thickness of the bead, in order to apply a transverse tension to the cover and guide the bead beyond the distal end of the return bearing.

10. The device according to claim 1, in which the surface to be covered is selected from the group consisting of:

a pond, filled or not with a liquid, such as a swimming pool, a water retaining, treatment or desalination pond;

a sports field, such as a tennis court or a cricket field;

a vehicle body, and a glazed surface such as a greenhouse, a winter garden or a vehicle window.

11. The device according to claim 2, in which the parking distance, $d_p$, is substantially zero, such that there is contact between the rim of the casing and the surface plane.

12. The device according to claim 11, in which the portion of the rim in contact with the surface plane is provided with a seal.

13. The device according to claim 1, wherein the height varying means comprise at least one electrical cylinder at each end of the carriage.

14. The device according to claim 4, wherein the core is fixed to the tubular sheath so as to prevent it from sliding along the sheath, while maintaining a flexibility of the bead that is sufficient for the operations of unwinding/winding of the cover over the surface to be covered.

* * * * *